US007450690B2

(12) United States Patent
Block et al.

(10) Patent No.: US 7,450,690 B2
(45) Date of Patent: Nov. 11, 2008

(54) REDUCED FOCAL SPOT MOTION IN A CT X-RAY TUBE

(75) Inventors: Wayne Frederick Block, Sussex, WI (US); Edward Emaci, Brookfield, WI (US); Sergio Lemaitre, Whitefish Bay, WI (US); Ron Kent Hockersmith, Waukesha, WI (US)

(73) Assignee: General Electric Company, Schenectady, NY (US)

( * ) Notice: Subject to any disclaimer, the term of this patent is extended or adjusted under 35 U.S.C. 154(b) by 620 days.

(21) Appl. No.: 11/160,796

(22) Filed: Jul. 8, 2005

(65) Prior Publication Data

US 2007/0007874 A1 Jan. 11, 2007

(51) Int. Cl.

| | |
|---|---|
| ***H01J 35/06*** | (2006.01) |
| ***H01J 35/30*** | (2006.01) |
| ***H01J 35/14*** | (2006.01) |
| ***H01J 17/04*** | (2006.01) |
| ***H01J 17/16*** | (2006.01) |

(52) U.S. Cl. ..... 378/136; 378/137; 378/138; 313/631; 313/634

(58) Field of Classification Search ..... 378/136, 378/137, 138; 313/631, 634
See application file for complete search history.

(56) References Cited

U.S. PATENT DOCUMENTS 2,889,482 A * 6/1959 Sokolov ..... 313/278

* cited by examiner

*Primary Examiner*—Edward J. Glick
*Assistant Examiner*—Mona M Sanei

(57) ABSTRACT

An x-ray tube assembly is provided comprising a tube casing assembly including a plurality of vertical mount posts. An insulator plate is mounted to the plurality of vertical mount posts such that the insulator plate can translate vertically on the posts. A cathode assembly is mounted to the insulator plate and generates both an eccentric moment and a vertical expansion in response to a cathode power load. A semi-compressible element is positioned between at least one of the vertical mount posts and the insulator plate. The semi-compressible element becomes incompressible at a cathode power threshold such that the vertical expansion is translated into a correction moment countering the eccentric moment.

20 Claims, 1 Drawing Sheet

REDUCED FOCAL SPOT MOTION IN A CT X-RAY TUBE

TECHNICAL FIELD

The present invention relates generally to an x-ray tube with reduced focal spot motion and more particularly to a CT x-ray tube generating a correction moment to partially counter the eccentric moment generated by the cathode assembly.

BACKGROUND OF THE INVENTION

Modern medical imaging assemblies, such as x-ray tubes, are becoming increasingly powerful as their respective technologies advance. The increase in power and complexity introduces physical characteristics to the assemblies such as thermal growth that can effect the performance characteristics of the imaging assembly. Often these performance altering characteristics are related directly to increase power usage and may negatively impact image quality.

One such known effect of many x-ray tube assemblies is lateral drift of the focal spots. Under typical operating conditions, it is desirable for focal spot drift to be minimized. In addition, with the use of large and small focal spots in combination, it is often desirable for their drifts to be in opposite directions. Yet as cathode assemblies become more powerful and complex, the thermal properties in combination with the mechanical configurations make such drift control difficult. This is highly undesirably and can reduce the ability of the installation team to achieve a high level of image quality during tube calibrations.

One approach to minimizing focal spot drift would be through the development and introduction of active magnetic or electrostatic controls into the cathode assembly or directly onto the electron beam. However, such an approach would add undesirable cost increases to the system in addition to undesirable complexity. In addition, such complex solutions may be economically or structurally unfeasible for implementation onto existing imaging assemblies. Therefore, the use of magnetic control of the electron beam to steer and control the motion of the focal spots may be undesirable in many circumstances.

It would, therefore, be highly desirable to have an x-ray tube assembly that minimized the drift of focal spots without necessitating the introduction of complex and costly electronic or magnetic controls. It would additionally be highly desirable to have an x-ray tube assembly that harnessed the natural physical properties of existing tube structures to reduce the focal spot drift.

SUMMARY OF THE INVENTION

An x-ray tube assembly is provided comprising a tube casing assembly including a plurality of vertical mount posts. An insulator plate is mounted to the plurality of vertical mount posts such that the insulator plate can translate vertically on the posts. A cathode assembly is mounted to the insulator plate and generates both an eccentric moment and a vertical expansion in response to a cathode power load. A semi-compressible element is positioned between at least one of the vertical mount posts and the insulator plate. The semi-compressible element becomes incompressible at a cathode power threshold such that the vertical expansion is translated into a correction moment countering the eccentric moment.

Other features of the present invention will become apparent when viewed in light of the detailed description of the preferred embodiment when taken in conjunction with the attached drawings and appended claims.

DESCRIPTION OF THE PREFERRED EMBODIMENT(S)

Figure 1:
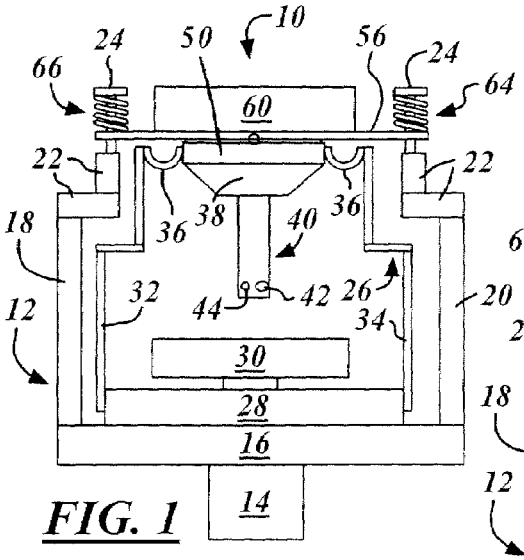
FIG. 1 is an illustration of an x-ray tube assembly in accordance with the present invention, the x-ray tube assembly illustrated in an un-powered state.

Referring now to FIG. 1, which is an illustration of an x-ray tube assembly 10 or specifically a computed tomography (CT) x-ray tube assembly 10 for use with the present invention. The assembly 10 includes a tube casing 12 including a casing mount 14. A variety of tube casings 12 and mounts 14 are contemplated by the present invention. A casing back plate 16, a first casing wall 18 and a second casing wall 20 are joined to form the tube casing 12. Upper casing mounting structures 22 are mounted to the casing walls 18, 20 in order to form a mounting surface for a plurality of vertical mount posts 24.

Within the tube casing 12 is mounted a tube insert 26 including an anode backplate 28 and a target assembly 30 mounted thereto. A first tube insert wall 32 and a second tube insert wall 34 are mounted to the anode backplate 28 and are utilized to support a plurality of flex mounts 36 acting as a flexible connection between the tube insert 26 and a cathode assembly 38. Although a variety of cathode assemblies 38 are contemplated, one embodiment contemplates a CT type cathode assembly. The cathode assembly 38 includes a tube element 40 preferably having a large filament element 42 and a small filament element 44. These filament elements 42, 44 generate a corresponding large filament focal spot 46 and small filament focal spot 48 on the target assembly 30.

When the cathode assembly 38 is powered with a cathode power load 50 in order to generate the focal spots 46,48, the cathode assembly 38 generates considerable thermal energy which generates thermal expansion 52 in addition to an eccentric moment 54 (skewing moment). The eccentric moment 54 if left unchecked can result in undesirable drift of the focal spots 46,48 and thereby result in a negative impact of imaging. The present invention, however, provides a unique mounting structure for the cathode assembly 38 that minimizes the undesirable drift without requiring complex electronic or magnetic controls.

The present invention's mounting structure includes an insulator plate 56 mounted to the plurality of vertical mount posts 24 such that the insulator post 56 can translate vertically along these posts 24. The cathode assembly 38 is mounted to the lower insulator surface 58. An insulator element 60 may be mounted to the upper insulator surface 62. A motion resistance spring 64 is mounted in between the insulator plate 56 and one of the vertical mount posts 24 on the right side of the tube casing 12 relative to the eccentric moment direction 54 (see FIG. 2). The motion resistance spring 64 preferably remains a compressible spring throughout the usage of the x-ray tube assembly 10.

In contrast, the present invention includes a semi-compressible element 66 positioned between the insulator plate 56 and a vertical mount post 24 opposite the motion resistance spring 64. The semi-compressible element 66 is designed to become incompressible at a predetermined cathode power threshold. In one embodiment, this is accomplished by the use of a semi-compressible spring or a plurality of washers 66 which form an incompressible cylinder 68 at the cathode power threshold. When the semi-compressible element 66 becomes the incompressible cylinder 68, the thermal expansion 52 of the cathode assembly 38 is translated into a correction moment 70 that opposes the eccentric moment 54 generated naturally by the cathode assembly 38. Thus the correction moment 70 counteracts the eccentric moment 54 and drift is thereby minimized.

Figure 2:
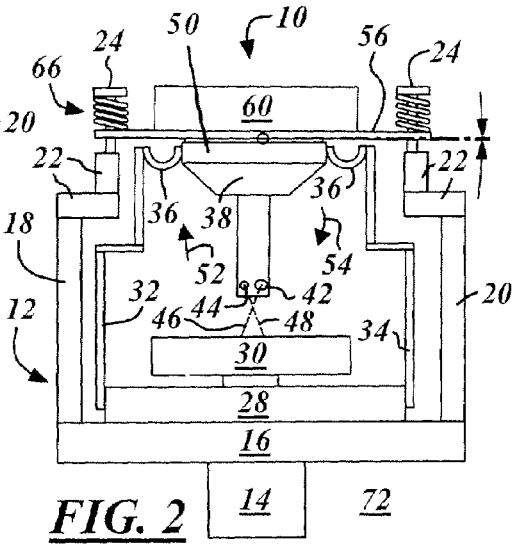
FIG. 2 is an illustration of the x-ray tube assembly shown in FIG. 1, the x-ray tube assembly illustrated in a low-powered state.
Figure 3:
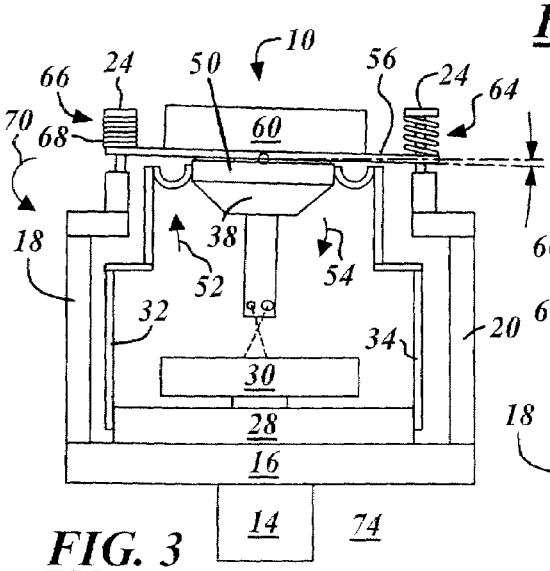
FIG. 3 is an illustration of the x-ray tube assembly shown in FIG. 1, the x-ray tube assembly illustrated in a mid-powered state.
Figure 4:
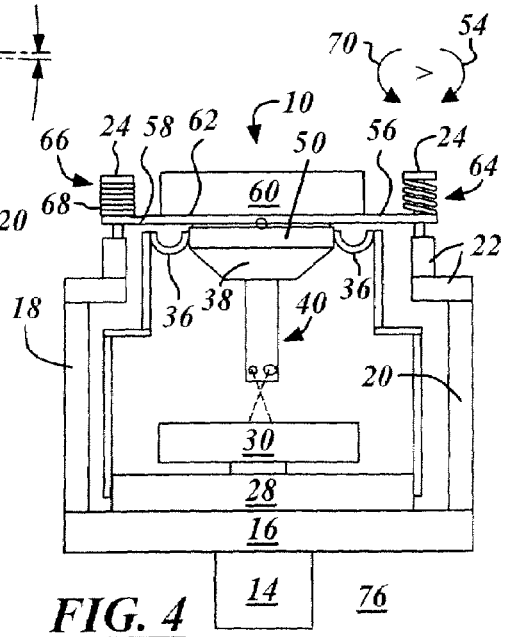
FIG. 4 is an illustration of the x-ray tube assembly shown in FIG. 1, the x-ray tube assembly illustrated in a high-powered state.

As is illustrated in FIGS. 1 through 4, the properties of the semi-compressible element 66 can be tailored as follows. In FIG. 1, the cathode assembly 38 is illustrated unpowered and the semi-compressible element 66 is illustrated in its compressible state. As the cathode power load 50 is increase to a low-powered state 72, for example 1 kW, as is illustrated in FIG. 2, the semi-compressible element 66 moves into the incompressible cylinder 68 due to the thermal expansion 52. At the same time the motion resistance spring 64 is actually extended due the simultaneously generated eccentric moment 54. As the cathode power load 50 is then increased from the low-powered state 72 to a mid-powered state 74, such as 3 kW, as shown in FIG. 3, the incompressible cylinder 68 begins to translate the thermal expansion 52 into the correction moment 70 which acts to counteract the eccentric moment 54. Finally, as the mid-powered state 74 becomes a high-powered state 76, such as 8 kW, the motion resistance spring 64 is beginning to compress as the original alignment (non-skew) is achieved. It should be understood, however, that the wattage levels are for example purposes only and represent only a single embodiment. The semi-compressible element 66 may be specifically tailored to match the eccentric moment 54 of a given cathode assembly 12. As such, the incompressible cylinder may be initially formed at low, medium, or high powered states depending on the strength and onset of the eccentric moment 54.

While particular embodiments of the invention have been shown and described, numerous variations and alternative embodiments will occur to those skilled in the art. Accordingly, it is intended that the invention be limited only in terms of the appended claims.

What is claimed is:

1. An x-ray tube assembly comprising:

a tube casing assembly including a plurality of vertical mount posts;

an insulator plate mounted to said plurality of vertical mount posts such that said insulator plate can translate vertically on said vertical mount posts;

a cathode assembly mounted to said insulator plate, said cathode assembly generating an eccentric moment and a vertical expansion in response to a cathode power load and;

a semi-compressible element positioned between at least one of said vertical mount posts and said insulator plate, said semi-compressible element becoming incompressible at a cathode power threshold such that said vertical expansion is translated into a correction moment countering said eccentric moment.

2. An x-ray tube assembly as described in claim 1, wherein said semi-compressible element comprises a semi-compressible spring, said semi-compressible spring forming an incompressible cylinder at said cathode power threshold.

3. An x-ray tube assembly as described in claim 1, wherein said semi-compressible element comprises a plurality of washers, said plurality of washers forming an incompressible cylinder at said cathode power threshold.

4. An x-ray tube assembly as described in claim 1, wherein said cathode power threshold is low.

5. An x-ray tube assembly as described in claim 1, wherein said cathode power threshold is in the mid-range of the tube's power.

6. An x-ray tube assembly as described in claim 1, wherein said cathode assembly comprises a high power X-ray tube.

7. An x-ray tube assembly as described in claim 1, further comprising:

a tube insert mounted within said tube casing assembly, said cathode assembly mounted to said tube insert by way of a plurality of flex mounts.

8. An x-ray tube assembly as described in claim 1, wherein said cathode assembly comprises a large filament element and a small filament element adjacently mounted.

9. An x-ray tube assembly as described in claim 1, further comprising:

an insulation element mounted on an upper surface of said insulation plate.

10. An x-ray tube assembly comprising:

a tube casing assembly including a plurality of vertical mount posts, said tube casing assembly including a casing back plate, a first casing wall, and a second casing wall;

a tube insert mounted within said tube casing assembly, said tube insert comprising an anode back plate mounted to said casing back plate, a first insert wall mounted to said anode back plate, and a second insert wall mounted to said anode back plate;

a target element mounted to said anode back plate;

an insulator plate mounted to said plurality of vertical mount posts such that said insulator plate can translate vertically on said vertical mount posts;

a cathode assembly mounted to said insulator plate, said cathode assembly further mounted to said first insert wall and said second insert wall by way of a plurality of flex mounts positioned between said cathode assembly and said first insert wall and said second insert wall, said cathode assembly generating an eccentric moment in response to a cathode power load and;

a semi-compressible element positioned between at least one of said vertical mount posts and said insulator plate, said semi-compressible element becoming incompressible at a cathode power threshold such that said semi-compressible element generates a correction moment countering said eccentric moment.

11. An x-ray tube assembly as described in claim 10, wherein said cathode assembly generates a vertical expansion in response to said cathode power load, said semi-compressible element translating said vertical expansion into said correction moment when said semi-compressible element becomes incompressible.

12. An x-ray tube assembly as described in claim 10, wherein said semi-compressible element comprises a semi-compressible spring, said semi-compressible spring forming an incompressible cylinder at said cathode power threshold.

13. An x-ray tube assembly as described in claim 10, wherein said semi-compressible element comprises a plurality of washers, said plurality of washers forming an incompressible cylinder at said cathode power threshold.

14. An x-ray tube assembly as described in claim 10, wherein said cathode power threshold is low.

15. An x-ray tube assembly as described in claim 10, wherein said cathode power threshold is in the mid-range of the tube's power.

16. A method of countering the eccentric moment generated by a cathode assembly within an x-ray tube assembly comprising:

mounting the cathode assembly to an insulator plate vertically translatable on a plurality of vertical mount posts;

mounting a semi-compressible element between one of said vertical mount posts and said insulator plate, said semi-compressible element becoming incompressible at a cathode power threshold;

raising the cathode assembly to said cathode power threshold;

translating vertical expansion of the cathode assembly into a correction moment using said semi-compressible element and;

using said correction moment to counteract the eccentric moment to minimize focal spot drift.

17. A method as described in claim 16, wherein said semi-compressible element comprises a semi-compressible spring, the method further comprising:

forming an incompressible cylinder using said semi-compressible spring at said cathode power threshold.

18. A method as described in claim 16, wherein said semi-compressible element comprises a plurality of washers, the method further comprising:

forming an incompressible cylinder using said plurality of washers at said cathode power threshold.

19. A method as described in claim 16, further comprising:

reaching said cathode power threshold at a low-powered state.

20. A method as described in claim 16, further comprising:

reaching said cathode power threshold at a mid-powered state.

* * * * *